US006471294B1

(12) United States Patent
Dammermann et al.

(10) Patent No.: US 6,471,294 B1
(45) Date of Patent: Oct. 29, 2002

(54) ADJUSTABLE LUMBAR SUPPORT

(75) Inventors: Arnold B. Dammermann, Winona, MN (US); Kurt Heidmann, Grand Rapids, MI (US); Bruce M. Smith, Grand Rapids, MI (US); Michael W. Welsh, Rockford, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/564,934

(22) Filed: May 4, 2000

(51) Int. Cl.[7] ..... A47C 3/025
(52) U.S. Cl. ..... 297/284.7; 297/284.4
(58) Field of Search ..... 297/284.1, 284.4, 297/284.5, 440.1, 284.7, 230.14, 230.13, 230.1, 452.3, DIG. 2; 5/653

(56) References Cited

U.S. PATENT DOCUMENTS

| | | | | |
|---|---|---|---|---|
| 2,550,831 | A | | 5/1951 | Lingenfelter |
| 2,756,809 | A | | 7/1956 | Endresen |
| 2,815,798 | A | * | 12/1957 | Lohans |
| 2,831,533 | A | * | 4/1958 | Pasquarelli |
| 2,894,565 | A | * | 7/1959 | Conner |
| 2,991,124 | A | | 7/1961 | Schwarz |
| 3,463,544 | A | | 8/1969 | Froelich |
| 3,663,057 | A | | 5/1972 | Lohr et al. |
| 3,695,696 | A | | 10/1972 | Lohr et al. |
| 4,123,105 | A | | 10/1978 | Frey et al. |
| 4,156,544 | A | | 5/1979 | Swenson et al. |
| 4,182,533 | A | | 1/1980 | Arndt et al. |
| 4,189,182 | A | * | 2/1980 | Rhoe |
| 4,239,282 | A | | 12/1980 | White |
| 4,541,670 | A | | 9/1985 | Morgenstern et al. |
| 4,597,386 | A | * | 7/1986 | Goldstein |
| 4,632,454 | A | | 12/1986 | Naert |
| 4,634,176 | A | | 1/1987 | Scott |

(List continued on next page.)

*Primary Examiner*—Milton Nelson, Jr.
(74) *Attorney, Agent, or Firm*—Price Heneveld Cooper DeWitt & Litton

(57) ABSTRACT

A chair includes a flexible back shell, a back covering that covers at least a portion of a front surface of the back shell, and an adjustable lumbar device positioned between the back shell and the back covering. The adjustable lumbar device is flexible so that the lumbar device will flex to conform to a horizontal shape of the chair back shell, but is relatively stiff in a direction perpendicular to a front surface of the back shell, such that the lumbar device provides good lumbar support. The lumbar device is positioned between the back shell and the back covering for vertical height adjustment, and frictionally engages the same to retain its adjusted position. Further, the adjustable lumbar device includes rearwardly-extending protrusions that engage slots in the back shell to form a detent-like feature for holding a selected position, and further includes forwardly protruding tabs that act as handles for grasping the lumbar device for adjustment. In a preferred form, the back covering is tensioned such that it presses the lumbar adjustment device against the back shell for better holding power.

23 Claims, 5 Drawing Sheets

U.S. PATENT DOCUMENTS 4,634,178 A 1/1987 Carney
4,676,550 A 6/1987 Neve De Mevergnies
4,718,724 A * 1/1988 Quinton et al.
4,722,569 A 2/1988 Morgenstern et al.
4,730,871 A 3/1988 Sheldon
4,746,168 A 5/1988 Bracesco
4,799,736 A 1/1989 Kassai
4,811,986 A 3/1989 Hattori et al.
4,834,455 A 5/1989 Proctor
4,900,085 A 2/1990 Tobler
4,909,572 A 3/1990 Kanai
4,950,032 A 8/1990 Nagasaka
5,015,038 A 5/1991 Mrotz, III
5,022,709 A 6/1991 Marchino
5,102,196 A 4/1992 Kaneda et al.
5,112,106 A 5/1992 Asbjornsen et al.
5,261,723 A 11/1993 Hosoe
5,281,002 A 1/1994 Dauphin
5,297,851 A 3/1994 Van Hekken
5,314,240 A 5/1994 Ishi et al.
5,326,155 A 7/1994 Wild
5,335,965 A 8/1994 Sessini
5,338,099 A 8/1994 Ishi et al.
5,397,162 A * 3/1995 Huang
5,460,427 A 10/1995 Serber
5,474,358 A 12/1995 Maeyaert
5,482,353 A 1/1996 Lance
5,494,332 A 2/1996 Daniel
5,499,859 A 3/1996 Angell
5,507,559 A 4/1996 Lance
5,538,326 A 7/1996 Lorbiecki
5,542,743 A 8/1996 Olson et al.
5,567,010 A 10/1996 Sparks
5,567,011 A 10/1996 Sessini
5,582,460 A 12/1996 Schultz
5,599,069 A 2/1997 Lorbiecki
5,630,650 A 5/1997 Peterson et al.
5,641,205 A 6/1997 Schmidt
5,658,047 A 8/1997 Ratza et al.
5,685,606 A 11/1997 Lance
5,709,431 A * 1/1998 Horn
5,711,575 A 1/1998 Hand et al.
5,716,098 A 2/1998 Lance
5,722,725 A 3/1998 McNaughton
5,769,490 A 6/1998 Falzon
5,775,779 A * 7/1998 Abu-Isa et al.
5,782,536 A 7/1998 Heidmann et al.
5,788,328 A 8/1998 Lance
5,797,652 A 8/1998 Darbyshire
5,820,221 A 10/1998 Greaves et al.
5,860,700 A 1/1999 Lance
5,863,095 A 1/1999 Rivard et al.
5,902,011 A 5/1999 Hand et al.
5,947,559 A 9/1999 Williams
5,975,632 A 11/1999 Ginat
6,019,421 A * 2/2000 Roh
6,059,362 A * 5/2000 Lin
6,059,368 A * 5/2000 Stumpf et al.
6,126,235 A * 10/2000 Grove
6,219,867 B1 * 4/2001 Yates
6,299,248 B1 * 10/2001 Gennaro et al.

* cited by examiner

ADJUSTABLE LUMBAR SUPPORT

BACKGROUND

The present invention relates to a chair incorporating an adjustable lumbar device, and more particularly relates to a chair having a back, a back covering and an adjustable lumbar device positioned therebetween.

Recently, chair users and seating manufacturers have recognized the value and health benefit to customers of providing good adjustable lumbar support. Many different adjustable lumbar devices and arrangements are known; however, such devices are often expensive, complicated, include numerous parts, and/or have a poor appearance. Further, they are often difficult to adjust and/or not intuitive to adjust, such that customers do not (or are unable to) adjust them.

Aside from the above problems, there is a need for a lumbar device capable of cooperating with a highly flexible back, such as the novel back construction described in U.S. Pat. No. 5,871,258, issued Feb. 16, 1999. For example, where a chair back is highly flexible and also laterally flexible, a laterally stiff lumbar device can undesirably take away from the overall comfort and flexibility of the chair back. Notably, there is a lumbar adjustment device disclosed in the '258 patent, however it is made from relatively stiff material, such that the chair back tends to conform to a shape of the lumbar device instead of visa versa. Specifically, the lumbar device shown in the '258 patent is rigid enough to change a shape of the back shell, which may not always result in a best lumbar support arrangement or support. Further, the disclosed lumbar adjustment device includes vertically extending fingers that can get caught in the horizontal slots located in the lumbar area of the back shell during vertical adjustment of the lumbar device, which can limit adjustability or create a poor feel to the operator during adjustment. Still further, this lumbar device includes multiple parts and pieces that must be assembled, and that may come apart or not work properly if abused in the field.

There is also an adjustable lumbar device disclosed in U.S. Pat. No. 6,062,649, issued May 16, 2000. However, like the lumbar device disclosed in the '258 patent, this adjustable lumbar device is also made of multiple parts and pieces, and has stiff sections. Further, the lumbar device of this patent is made to function with a relatively stiff back and is not made to function with a highly flexible back shell, as in the present invention. Further, it is noted that the lumbar device of this patent teaches the use of guides along edges of the back to guide vertical adjustment of the disclosed lumbar device, which guides can wear and result in warranty.

Accordingly, an adjustable lumbar device is desired that solves the aforementioned problems and that has the aforementioned advantages.

SUMMARY OF THE INVENTION

In one aspect of the present invention, a chair includes a back having first edges and a lumbar section with horizontal slots, a back cover covering a front surface of the back and having second edges, and an adjustable lumbar device positioned between the back and back cover. The adjustable lumbar device includes rearwardly-extending detent projections extending into engagement with the horizontal slots for holding the lumbar support in a selected position. The adjustable lumbar support further includes end sections that extend outboard of the second edges and that are configured to be grasp so that a seated user can easily adjust a height of the adjustable lumbar device.

In another aspect of the present invention, a lumbar device includes an elongated polymeric body having front wall sections, rear wall sections, and transverse wall sections. The front wall sections are shaped to provide good lumbar support to a lumbar region of a seated user, and the rear wall sections shaped to slidably engage a front surface of a chair back support. The transverse wall sections join the front and rear wall sections and form vertical ribs in the body. The body, when in a chair-installed position, is flexible and characteristically non-self-supporting so that it is easily bendable about vertical axes that extend parallel the vertical ribs. This makes the body easily bendable to a side-to-side shape of the chair back support. However, the body is at the same time relatively stiff in a direction perpendicular to the front wall sections to provide good ergonomic support to the lumbar region of a seated user's back.

In another aspect of the present invention, a chair includes a back support, a back covering, and a lumbar device positioned between the back support and the back covering. At least one of the back covering and the lumbar device are translucent or transparent so that a seated user can both see the lumbar device and also see an adjusted position of the lumbar device relative to the back support through one of the back covering and an end of the lumbar device.

In another aspect of the present invention, a method comprises steps of providing a chair having a back support with a front surface, and covering at least a portion of the front surface with a back covering. The method further includes positioning a lumbar device between the front surface of the back support and the portion of the back covering, and vertically adjusting the lumbar device to a selected height and holding the lumbar device in the selected height solely by friction and without use of a vertical guide.

These and other features, advantages, and objects of the present invention will be further understood and appreciated by those skilled in the art by reference to the following specification, claims, and appended drawings.

DETAILED DESCRIPTION OF DETAILED EMBODIMENTS

Figure 1:
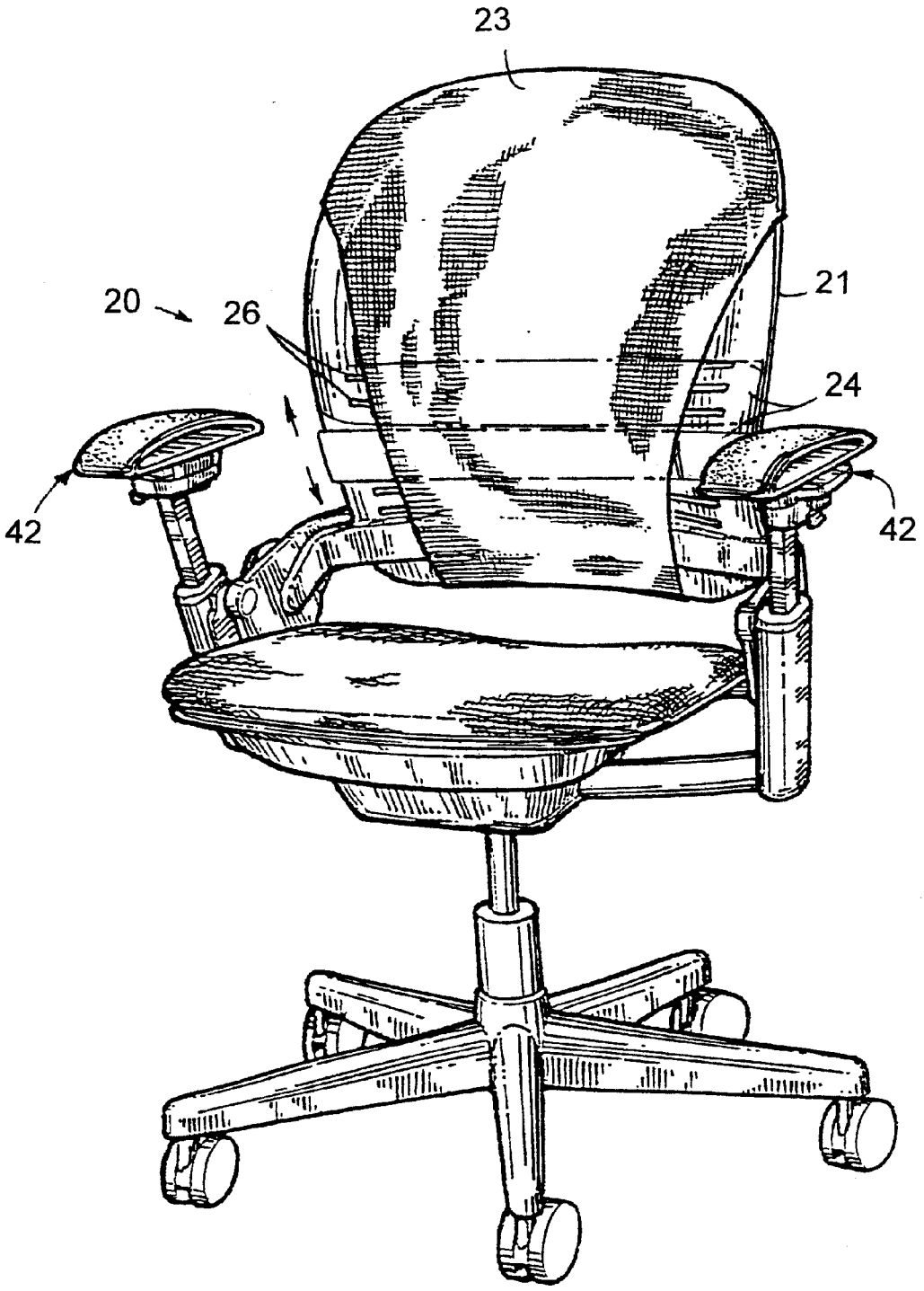
FIG. 1 is a front perspective view showing a chair incorporating the present lumbar adjustment device.
Figure 2:
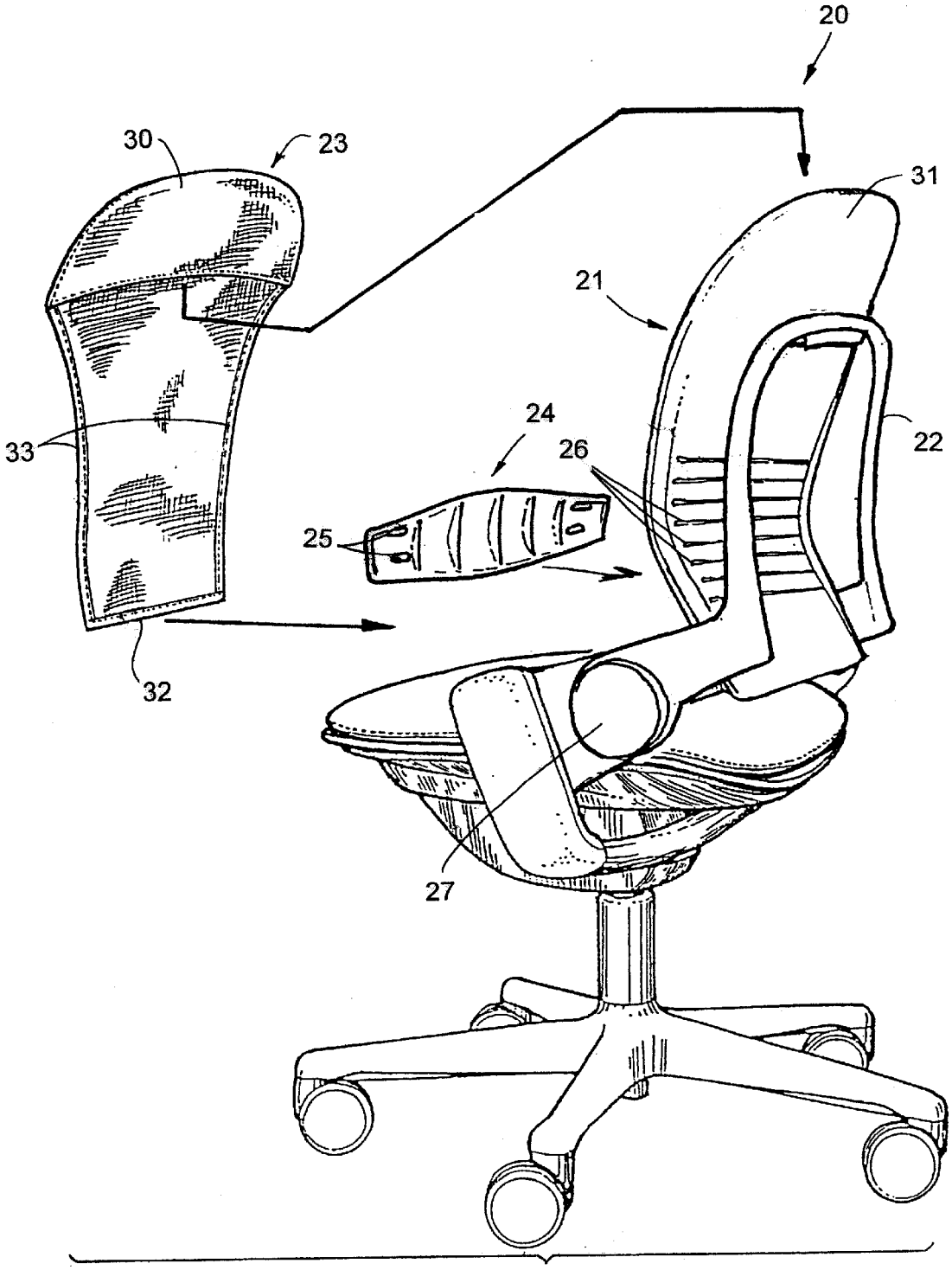
FIG. 2 is a rear exploded perspective view showing the chair of FIG. 1.

A chair 20 (FIG. 1) includes a flexible back shell 21 operably supported on an arching back frame 22 (FIG. 2) for both lateral and vertical flexure. A back covering 23 covers most of a front surface of the back shell 21, and an adjustable lumbar device 24 is positioned between the back shell 21 and the back covering 23. The back covering 23 is tensioned from top to bottom and the lumbar device 24 has a friction-generating surface, such that the adjustable lumbar device 24 is frictionally retained between the back shell 21 and the back covering 23. As illustrated, the lumbar device 24 further includes protrusions 25 for detentingly engaging slots 26 in a lumbar area of the back shell 21. The adjustable lumbar device 24 is preferably relatively flimsy and, bendable so that the lumbar device 24 will flex to conform to a horizontal shape of the chair back shell 21, but is relatively stiff in a direction perpendicular to a front surface of the back shell 21, so that the lumbar device 24 maintains its crescent-shaped cross section and provides good lumbar support to a seated user.

A chair having a back shell, back frame, and adjustable lumbar device of interest is shown in U.S. Pat. No. 5,871,258. The back shell and back frame in the '258 patent are similar to the present back shell 21 and back frame 22, and thus the '258 patent may be referred to by the reader for a more detailed understanding of the back shell 21 and the back frame 22 and for an understanding of the general operation of a chair incorporating these components. Nonetheless, the back shell 21 and back frame 22 are sufficiently disclosed herein for an understanding of the present invention. The disclosure of U.S. Pat. No. 5,871,258 is incorporated herein in its entirety by reference.

The back shell 21 (FIG. 1) is made of relatively flexible material, and further includes slots 26 in a lumbar area of the chair, causing the lumbar area to be even more flexible. The side edges of the back shell 21 (FIG. 1) are. non-parallel and form an inwardly tapered bottom section of the back shell 21.

Figure 3:
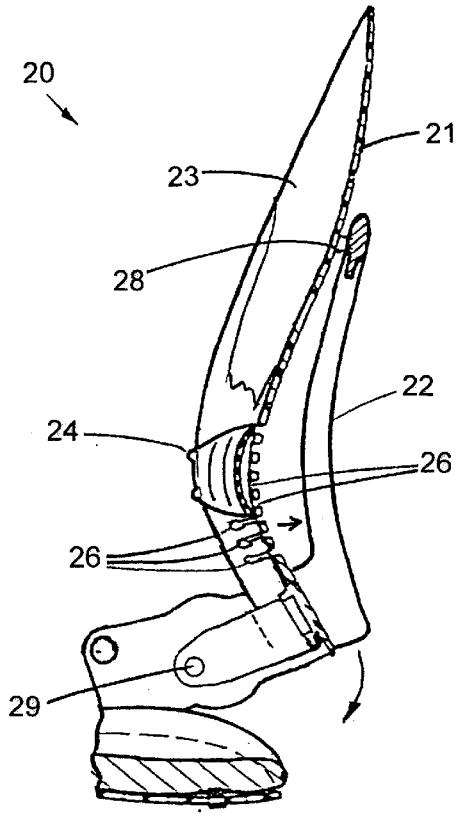
FIG. 3 is a vertical cross section taken centrally through FIG. 1.

The back frame 22 (FIG. 3) is pivotally connected to the back shell 21 at top and bottom pivots 28 and 29. The top and bottom pivots 28 and 29 permit the back shell to flex in a controlled manner in the lumbar area of the back shell 21 as a seated user flexes their lower back and spine. The back shell 21 is biased to a forwardly convex shape by a lumbar biasing device 27 (FIG. 2) at bottom pivot 29 (FIG. 3) for optimal lumbar support.

A covering 23 (sometimes referred to as a "vest") (FIG. 2) includes a sock-like top section 30 that slips over and engages a top section 31 of the back shell 21. A bottom edge 32 of the covering 23 includes a stiff strip that frictionally engages a groove along a lower edge of the back shell 21 with a zip-lock-like action. The edges 33 of the illustrated covering 23 are cut at an angle and extend diagonally inwardly from top to bottom in a manner exposing ends of the slots 26. This highlights the lumbar area of the back shell 21, and helps give the chair 20 a modern and "high tech" appearance. The covering 23 is made of a stretchable material, and is tensioned when installed, such that the covering 23 is drawn tight across a front surface of the back shell 21 without wrinkles.

Figure 6:
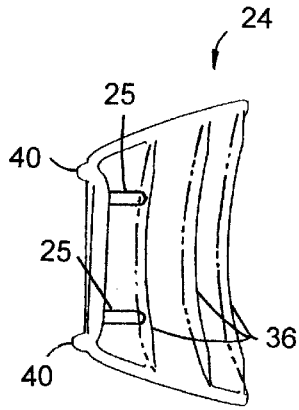
FIGS. 4, 5, and 6 are top, front and side views of the lumbar device shown in FIG. 1.
Figure 4:
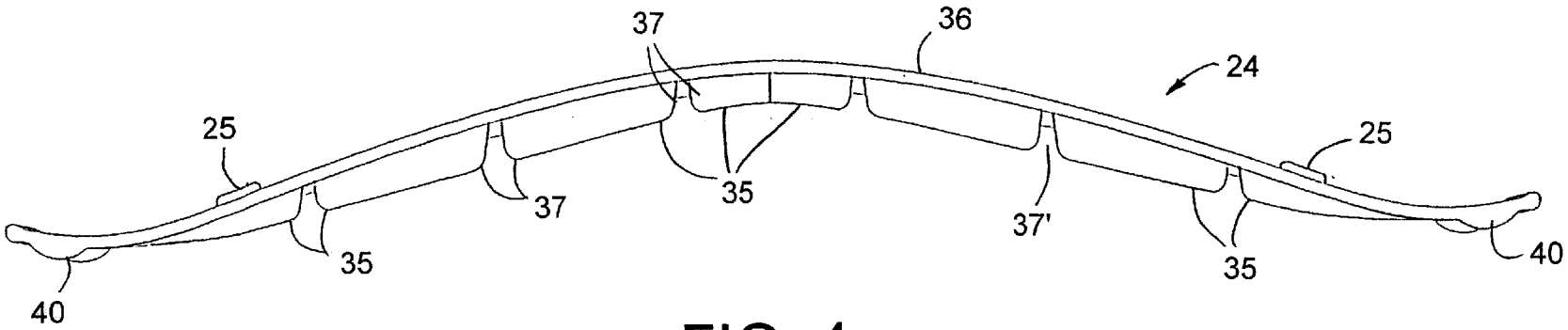
Figure 5:
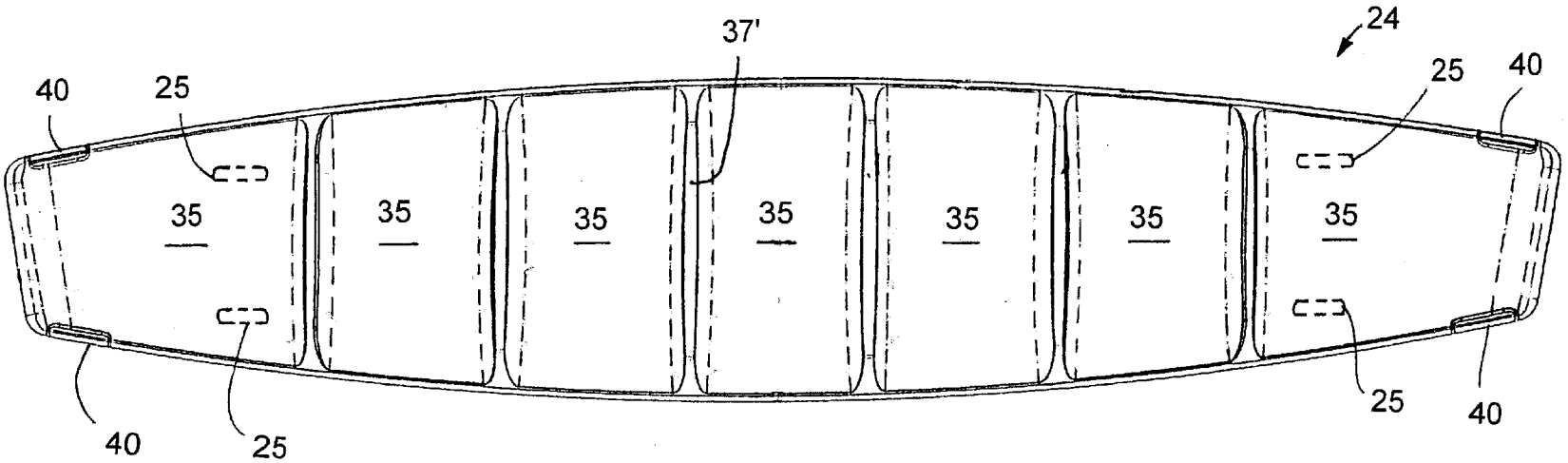
Figure 8:
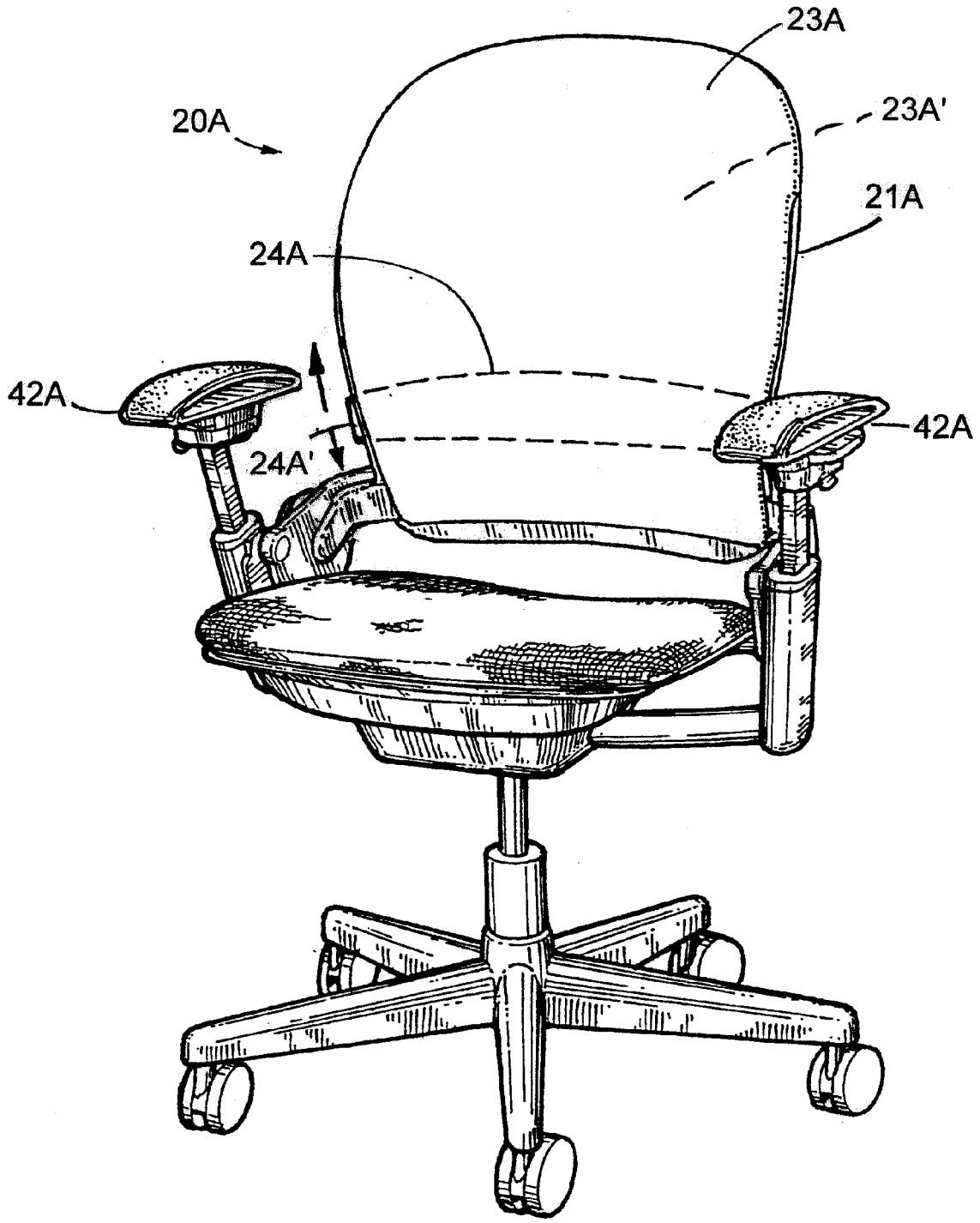
FIG. 8 is a front view of a modified chair similar to FIG. 1 but including a chair having a cushion assembly covering a front surface of its back.

The lumbar device 24 (FIGS. 4–6) includes front wall sections 35, rear wall sections 36, and transverse wall sections 37. The rear wall sections 36 combine to form a rear surface that lies relatively flat against the front surface of the back shell 21 in the lumbar area of the back shell 21. Due to the coefficient of friction generated by the rubber-like material of the lumbar device 24 against the back shell 21, the lumbar device 24 tends to stay in an adjusted position. Nonetheless, protrusions 25 are optionally included that extend from the back surface for engaging the slots 26 in the back shell 21. Pairs of the protrusions 25 can be spaced vertically apart on each end section of the lumbar device 24, thus creating a rectangular matrix that tends to orient the lumbar device as the protrusions 25 engage the slots 26. The transverse wall sections 37 are crescent-shaped, and form channels or ribs 37'that extend vertically on the lumbar device 24 to stiffen the lumbar device 24 in a way so that the forward wall sections 35 maintain their forwardly convex shape even when the lumbar device 24 is leaned on by a seated user.

The transverse wall sections 37 provide stiffening in a plane that extends vertically and forwardly/rearwardly on the chair. However, the lumbar device 24 is made from a relatively flexible material, such as a polyurethane elastomer made by Dow Chemical Company called PELLETHANE. The optimal material has a Shore A. durometer hardness of 83A, and is rubber-like with a surface that (when newly molded) is almost tacky. This provides a strong holding force when the lumbar device 24 is squeezed between the back shell 21 and the back covering 23. The particular preferred material of the lumbar device 24 has a flexural modulus that is so low that its flexural modulus under ASTM D790 is not given on the material specification sheet provided by the manufacturer. (The flexural modulus is believed to be below 11,000 psi since the flexural modulus of other variations of similar materials are given on the specification sheet.) The preferred material forms a lumbar device that is surprisingly and unexpectedly weak and bendable. For example, if one end of the lumbar section 24 is grasp and held in a horizontal orientation, the rest of the lumbar device 24 droops to a vertical position. This allows the lumbar device 24 to conform to the side-to-side shape of the lumbar area of the back shell 21, and further allows the lumbar device 24 to flex and follow the changing shape of the back shell 21 as a person leans and twists in the chair 20, such as during recline or when reaching toward one side of the chair. The material of the lumbar device preferably has excellent abrasion resistance, good low temperature flexibility, good impact resistance, good resistance to non-polar solvents, a high compressive strength, and easy processability.

The preferred material of the lumbar device 24 is transparent or translucent. This provides a very distinctive modernistic look. Advantageously, the transparency of the material allows a user to see through the lumbar device 24 sufficiently to see the slots engaged by the protrusions 25. This allows a user to easily see exactly how the lumbar device 24 is adjusted before sitting in the chair 20. The vest or covering 23 also allows some see-through to allow a user to see the lumbar device 24 through the fabric. This also provides a distinctive attractive appearance, and also helps a user identify an adjusted position of the lumbar device 24. Notably, a combination of the clear lumbar device 24 and the clear top covering on the armrests 42 provides a very attractive and high-tech appearance.

The end sections of the lumbar device 24 (FIGS. 4–6) include forwardly extending tabs 40, one tab being on the top and one on the bottom of each end section. The tabs 40 extend forwardly sufficiently to act as handles for grasping by a user. Notably, the tabs 40 are only long enough to provide a stub that can be gripped by fingers, but not "too long". A reason is because in the highest adjusted position of the lumbar device 24, the top tab 40 may actually slip under the covering 23.

Figure 7:
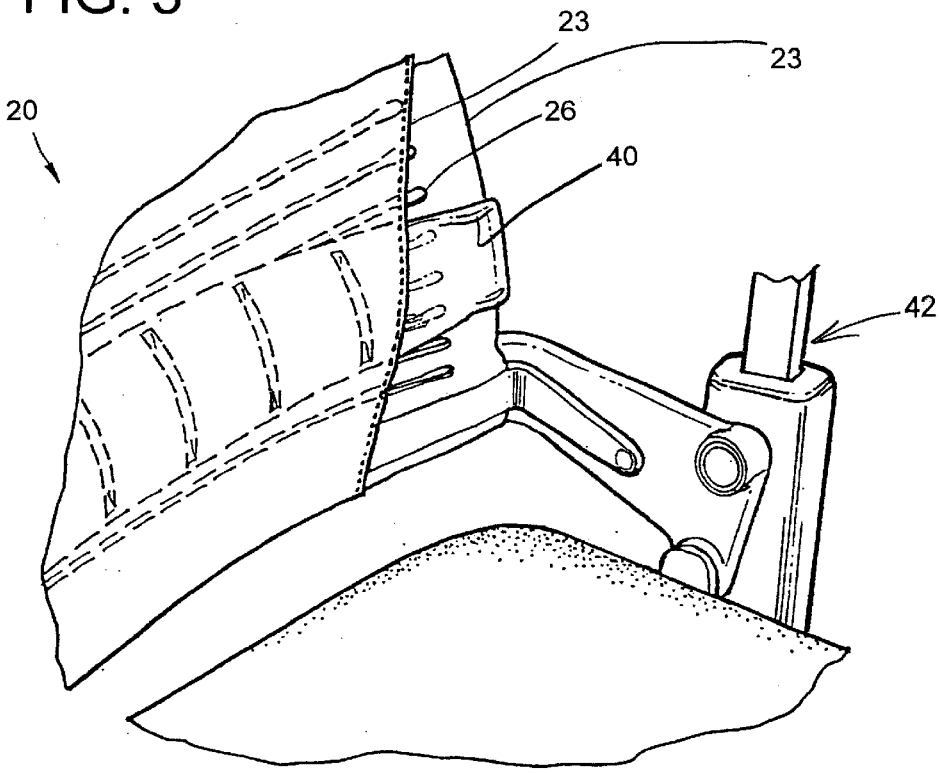
FIG. 7 is an enlarged, fragmentary perspective view of FIG. 1.

A second embodiment of the chair 20A (FIG. 7) includes many features and components that are identical or similar to the chair 20. To reduce redundant discussion, the components and features of chair 20A that are similar to chair 20 are referred to by the same identification number, but with the addition of a letter "A". The covering 23A is an assembly that includes fabric sewn around a cushion 23A'. The edges of the covering 23A extend to and follow the edges of the back shell 21A. The end sections 24A of the lumbar device 24A extend to locations just outboard of the edges of the back shell 21A when the lumbar device 24A is positioned in its highest adjusted position. In the lowest adjusted position, the end sections of the lumbar device 24A extend significantly outboard of the edges of the back shell 21A, since the edges of the back shell 21A are tapered inwardly near their bottom portions. Nonetheless, the transparency of the end sections reduces their visibility/noticeability, and the transparency creates a novel high tech appearance that is desirable in the chair 20A.

In the foregoing description, those skilled in the art will readily appreciate that modifications can be made to the invention without departing from the concepts disclosed herein. Such modifications are to be considered as included in the following claims, unless these claims, by their language, expressly state otherwise.

The embodiments of the invention in which an exclusive property are privilege as claimed, are defined as follows:

1. A chair comprising:

a back having first edges and a lumbar section with horizontal slots therein that provide flexibility to the lumbar section;

a back cover covering a front surface of the back and having second edges; and an adjustable lumbar device positioned between the back and back cover, the adjustable lumbar device including integrally-molded rearwardly-extending detent projections extending into engagement with the horizontal slots for holding the lumbar device in a selected position.

2. The chair defined in claim 1, wherein the lumbar device includes end sections that extend inboard of the first edges and outboard of the second edges, the end sections defining handles that extend forwardly of the front surface of the back.

3. A chair comprising:

a back having first edges and a lumbar section with horizontal slots therein;

a back cover covering a front surface of the back and having second edges; and an adjustable lumbar device positioned between the back and back cover, the adjustable lumbar device including rearwardly-extending detent projections extending into engagement with the horizontal slots for holding the lumbar device in a selected position, the lumbar device being one-piece.

4. The chair defined in claim 3, wherein the back cover includes a fabric and characteristically does not include a cushion.

5. The chair defined in claim 3, wherein the back includes a front surface, and wherein the lumbar device includes relatively flat sections that lie against and frictionally engage the front surface to provide friction for holding the lumbar device in a selected position.

6. The chair defined in claim 3, wherein the back cover is tensioned and drawn tight over the back, such that the lumbar device is lightly compressed between the back and the back cover.

7. A chair comprising:

a back having first edges and a lumbar section with horizontal slots therein;

a back cover covering a front surface of the back and having second edges; and an adjustable lumbar device positioned between the back and back cover, the adjustable lumbar device including rearwardly-extending detent projections extending into and out of selective engagement with the horizontal slots during adjustment for holding the lumbar device in a selected position, wherein the lumbar device is made from a material having a flexural strength of less than 11,000 psi.

8. A chair comprising:

a back having first edges and a lumbar section with horizontal slots therein;

a back cover covering a front surface of the back and having second edges; and an adjustable lumbar device positioned between the back and back cover, the adjustable lumbar device including rearwardly-extending detent projections extending into engagement with the horizontal slots for holding the lumbar device in a selected position, the lumbar device including ends made from light-transmitting material that are visible between the first and second edges.

9. The chair defined in claim 8, wherein the lumbar device is made from transparent material.

10. A lumbar device comprising:

an elongated polymeric body including front wall sections shaped to provide good lumbar support to a lumbar region of a seated user, rear wall sections shaped to slidably engage a front surface of a chair back support, and transverse wall sections joining the front and rear wall sections and forming vertical ribs in the body; the body, when in a chair-installed position, being flexible and characteristically non-self-supporting and easily bendable about vertical axes, such that the body is adapted to easily bend to a side-to-side shape of the chair back support, but the body being relatively stiff in a direction perpendicular to the front wall sections to provide good ergonomic support to the lumbar region of a seated user's back, the lumbar device being made from a material having a flexural strength of less than 11,000 psi.

11. A lumbar device comprising:

an elongated polymeric body including front wall sections shaped to provide good lumbar support to a lumbar region of a seated user, rear wall sections shaped to slidably engage a front surface of a chair back support, and transverse wall sections joining the front and rear wall sections and forming vertical ribs in the body; the body, when in a chair-installed position, being flexible and characteristically non-self-supporting and easily bendable about vertical axes, such that the body is adapted to easily bend to a side-to-side shape of the chair back support, but the body being relatively stiff in a direction perpendicular to the front wall sections to provide good ergonomic support to the lumbar region of a seated user's back, the lumbar device being one-piece.

12. A lumbar device comprising:

an elongated polymeric body including front wall sections shaped to provide good lumbar support to a lumbar region of a seated user, rear wall sections shaped to slidably engage a front surface of a chair back support, and transverse wall sections joining the front and rear wall sections and forming vertical ribs in the body; the body, when in a chair-installed position, being flexible and characteristically non-self-supporting and easily bendable about vertical axes, such that the body is adapted to easily bend to a side-to-side shape of the chair back support, but the body being relatively stiff in a direction perpendicular to the front wall sections to provide good ergonomic support to the lumbar region of a seated user's back, and including a detent device with integrally-molded, rearwardly-extending protrusions shaped and adapted to engage mating horizontal features in a chair back to retain the body in a vertically-adjusted position.

13. The lumbar device defined in claim 12, wherein the lumbar device has a low longitudinal strength such that, when an end of the lumbar device is held horizontally in a free state, the other end droops to a vertical position.

14. A chair comprising:

a back support;

a back covering; and a lumbar device positioned between the back support and the back covering, the lumbar device being light-transmissive so that a seated user can both see the lumbar device and also see an adjusted position of the lumbar device relative to the back support through an end of the lumbar device.

15. The chair defined in claim 14, wherein the lumbar device is made from a material having a flexural strength of less than 11,000 psi.

16. The chair defined in claim 14, wherein the lumbar device is one-piece.

17. The chair defined in claim 14, wherein the lumbar device is made from translucent material.

18. A lumbar device comprising:

an elongated polymeric body including front wall sections shaped to provide good lumbar support to a lumbar region of a seated user, rear wall sections shaped to slidably engage a front surface of a chair back support, and transverse wall sections joining the front and rear wall sections and forming vertical ribs in the body; the body, when in a chair-installed position, being flexible and characteristically non-self-supporting and easily bendable about vertical axes, such that the body is adapted to easily bend to a side-to-side shape of the chair back support, but the body being relatively stiff in a direction perpendicular to the front wall sections to provide good ergonomic support to the lumbar region of a seated user's back, the body being made from light-transmitting material.

19. A chair comprising:

a back having first edges and a lumbar section with horizontal slots therein;

a back cover covering a front surface of the back and having second edges; and an adjustable lumbar device positioned between the back and back cover, the adjustable lumbar device including end sections that extend outboard of the second edges and forward of the back so that a seated user can easily adjust a height of the adjustable lumbar device, the end sections each including a handle section that is located inboard of the first edges and outboard of the second edges.

20. A chair comprising:

a back having a lumbar section with vertically-spaced horizontal slots therein;

a back cover covering a front surface of the back and an adjustable lumbar device positioned between the back and back cover, the adjustable lumbar device including rearwardly-extending detent projections extending into selective engagement with the horizontal slots for detentingly holding the lumbar device in a selected position and the back cover being tensioned to compress the lumbar device against the back to thereby cause frictional engagement between the lumbar device and the back.

21. A chair comprising:

a back having first edges and a lumbar section with horizontal bands of material defining horizontal slots therein;

a back cover covering a front surface of the back and having second edges; and an adjustable lumbar device positioned between the back and back cover and the back cover being tensioned to hold the lumbar device frictionally against the back, the adjustable lumbar device including end sections that extend outboard of the second edges and forward of the back so that a seated user can easily adjust a height of the adjustable lumbar device, the lumbar device having detent projections that slide over the bands and detentingly selectively into engagement with the horizontal slots to hold the lumbar device in selected horizontal positions.

22. A chair comprising:

a back having first edges and a lumbar section with horizontal slots therein;

a back cover covering a front surface of the back and having second edges; and an adjustable lumbar device positioned between the back and back cover, the adjustable lumbar device including end sections that extend outboard of the second edges and forward of the back so that a seated user can easily adjust a height of the adjustable lumbar device, the lumbar device being one-piece.

23. The chair defined in claim 22, wherein the back cover is tensioned and drawn tight over the back, such that the lumbar device is lightly compressed between the back and the back cover.

* * * * *